US006379227B1

(12) United States Patent
Hellman et al.

(10) Patent No.: US 6,379,227 B1
(45) Date of Patent: Apr. 30, 2002

(54) ABRASIVE-BAND GRINDING DEVICE AND METHOD FOR CONTROLLING AN ABRASIVE-BAND GRINDING DEVICE DURING GRINDING OF FACES OF CROWNED ROLLS

(75) Inventors: Bjarne Hellman, Riihimäki; Seppo Parviainen, Kuopio, both of (FI)

(73) Assignee: Valmet Corporation, Helsinki (FI)

( * ) Notice: Subject to any disclaimer, the term of this patent is extended or adjusted under 35 U.S.C. 154(b) by 0 days.

(21) Appl. No.: 09/057,655

(22) Filed: Apr. 9, 1998

(30) Foreign Application Priority Data

Apr. 10, 1997 (FI) ..... 971488

(51) Int. Cl.[7] ..... B24B 5/00
(52) U.S. Cl. ..... 451/49
(58) Field of Search ..... 451/307, 310, 451/303, 296, 49

(56) References Cited

U.S. PATENT DOCUMENTS

| | | | | | |
|---|---|---|---|---|---|
| 165,762 | A | * | 7/1875 | Sawyer | 451/310 |
| 3,136,097 | A | * | 6/1964 | Liard | 451/310 X |
| 4,727,683 | A | * | 3/1988 | Lamb | 451/310 |
| 5,394,653 | A | | 3/1995 | Maier | 451/303 |
| 5,433,042 | A | * | 7/1995 | Billieres et al. | 451/49 |
| 5,584,752 | A | * | 12/1996 | Mizutani | 451/310 X |

FOREIGN PATENT DOCUMENTS

| | | | | |
|---|---|---|---|---|
| EP | 0242593 | | 7/1989 | |
| GB | 2135609 | | 9/1984 | |
| JP | 358010449 | * | 1/1983 | 451/307 |
| JP | 223854 | | 8/1992 | |
| WO | 9112111 | | 8/1991 | |
| WO | 9302834 | | 2/1993 | |
| WO | 9412315 | | 6/1994 | |

* cited by examiner

*Primary Examiner*—David A. Scherbel
*Assistant Examiner*—Anthony Ojini
(74) *Attorney, Agent, or Firm*—Steinberg & Raskin, P.C.

(57) ABSTRACT

An abrasive-band grinding device for rolls and method for grinding rolls in which a motor rotates an abrasive band such that the abrasive band is pressed against the face of the roll to be ground. Guide pulleys are arranged in a loop of the abrasive band and, between the guide pulleys, a rotatable contact pulley is arranged over which the abrasive band is pressed against the face to be ground. The contact pulley is controlled by an actuator, preferably a motor, so that it can be inclined in relation to the roll face to be ground.

20 Claims, 8 Drawing Sheets

"Prior art"

Solution of the invention

"Prior art"

ABRASIVE-BAND GRINDING DEVICE AND METHOD FOR CONTROLLING AN ABRASIVE-BAND GRINDING DEVICE DURING GRINDING OF FACES OF CROWNED ROLLS

FIELD OF THE INVENTION

The present invention relates to an abrasive-band grinding device for rolls, in particular crowned rolls, and a method for controlling an abrasive-band grinding device during the grinding of the faces of a roll, in particular crowned rolls.

BACKGROUND OF THE INVENTION

The grinding of crowned rolls for paper machines is a particularly difficult and demanding process. For example, the diameter of large so-called Yankee cylinders can be up to 5 meters, in which case, correcting or finishing grinding of the crowned shape requires particular operations in order that a satisfactory surface quality may be achieved.

In the prior art, the use of an abrasive-band grinding device in the grinding of the faces of crowned rolls is known. In abrasive-band grinding devices, the band is driven from the output of a motor by means of a drive pulley. The band is arranged to run over two reversing pulleys, and a separate backup pulley, i.e., a so-called contact pulley, is arranged between the reversing pulleys. The contact pulley forms a back stop whereby the abrasive band is pressed at the backup pulley against the face to be ground. The use of an abrasive band is highly advantageous especially in large-scale grinding work, as compared, for example, with the use of a grindstone. The reason for this is because the wear of the grindstone must be monitored constantly in view of the fact that along with the wear of the stone, the control parameters and the geometry of the device are also changed. By contrast, this does not occur in the case of a band because the band can always be kept in contact with the crowned face to be ground. Also, by means of a band, it is possible to grind without a grinding fluid, whereas a stone operates best when a grinding fluid is used.

In a first conventional prior art grinding process, the grinding device is passed in a direction parallel to the axis of the crowned roll, and guide rails of the grinding device are also placed in a direction parallel to the axis of the crowned roll. The band or the grinding means is fed, in a typical construction, in a direction perpendicular to the axial direction of the roll. The device is transferred after each grinding cycle further in the axial direction of the roll to be ground. In such a case, the grinding result becomes serrated.

It has been possible to avoid a serrated grinding result by means of a second prior art construction in which the grinding device has been arranged to follow a certain pattern. In this construction, the guides have been shaped curved in compliance with the crown form of the roll. A drawback of this type of device is the long time required when changing the settings of the device.

OBJECTS AND SUMMARY OF THE INVENTION

It is an object of the present invention to provide a novel solution for increasing the precision of grinding of faces of rolls in particular, crowned rolls.

It is another object of the present invention to provide new and improved grinding devices and methods in which separate guides are not needed, but rather, positive control of the backup or contact pulley is used.

In order to attain these objects, and others, in a grinding device in accordance with the invention, a backup pulley is inclined by means of a motor device along with the progress of grinding. Also, the contact pulley is always shifted so that the radius of the contact pulley at the grinding point always passes through the geometric axis of rotation of the crowned roll.

More specifically, the abrasive-band grinding device for rolls in accordance with the invention includes a looped abrasive band, rotation means coupled to the abrasive band for rotating the abrasive band, guide pulleys arranged in the loop of the abrasive band, a contact pulley arranged in the loop of the abrasive band between the guide pulleys and which presses the abrasive band against a face of the roll, and inclining means connected to the contact pulley for adjustably inclining the axis of rotation of the contact pulley. By inclining the axis of rotation of the contact pulley, the axis of rotation of the contact pulley may be maintained substantially parallel to the face of the roll and thus the abrasive band is pressed by the contact pulley in compliance with the face of the roll, i.e., it follows the contour of the face of the roll being ground. The inclining means may comprise an actuator or motor coupled directly or indirectly to the contact pulley, in which case, the device may include control means for controlling actuation of the actuator and thus the inclination of the axis of rotation of the contact pulley.

In certain embodiments, the grinding device includes a first stationary frame, a second frame arranged on the first frame and movable with respect thereto, and a third frame arranged on the second frame and movable with respect thereto. First bearing means are provided for revolvingly mounting the contact pulley on the third frame, and second bearing means are provided for pivotally mounting the third frame on the second frame. If the inclining means comprise a motor, it is preferably mounted at one end on the second frame and coupled at the other end to the third frame. The first bearing means may comprise a pair of bearings arranged on the third frame, one at each transverse side of the contact pulley, and the second bearing means may comprise a pair of bearings arranged on the second frame, one on each radial side of the contact pulley.

In addition to a motor, the inclining means may comprise control means connected to the motor for controlling the motor, and a spindle coupled to the motor and to the third frame. The motor displaces the spindle along a linear path, or if the spindle is a ball-screw device, simply displaces the same.

In the method in accordance with the present invention, both the inclination of the contact pulley and the position of this pulley in relation to the roll face are regulated. Both regulations are carried out under microprocessor control by means of separate motors, preferably electric stepping motors. It is possible to program the desired crown form of the face to be crowned in the microprocessor in advance of the actual grinding process.

More specifically, in certain embodiments, in the method for grinding rolls in accordance with the invention, a looped abrasive band is guided over guide pulleys, a contact pulley arranged in the loop of the abrasive band is pressed toward the roll to be ground such that the abrasive band is pressed thereby against a face of the roll to be ground, and the axis of rotation of the contact pulley is adjustably inclined in order to maintain the axis of rotation of the contact pulley substantially parallel to the face of the roll such that the abrasive band is pressed by the contact pulley in compliance with the face of the roll. In other words, the contact pulley may be inclined until the face of the contact pulley is substantially parallel to a tangent of the roll at each grinding point.

The invention will be described in detail with reference to some preferred embodiments of the invention illustrated in the figures in the accompanying drawing. However, the invention is not confined to the illustrated embodiments alone.

BRIEF DESCRIPTION OF THE DRAWINGS

Additional objects of the invention will be apparent from the following description of the preferred embodiment thereof taken in conjunction with the accompanying non-limiting drawings, in which.

DETAILED DESCRIPTION OF THE PREFERRED EMBODIMENTS

Figure 1A:
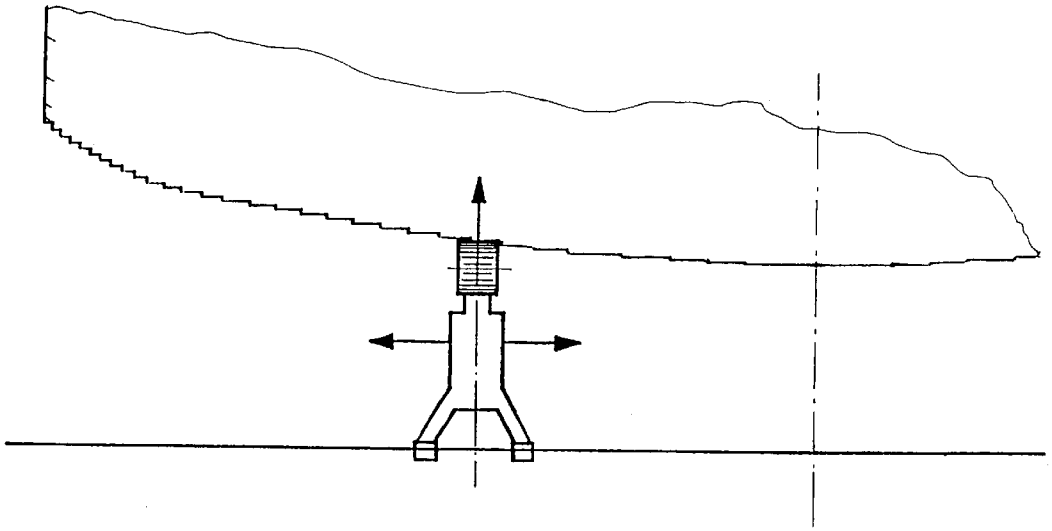
FIG. 1A illustrates a prior art grinding method.

Referring to the accompanying drawings wherein like reference numerals refer to the same or similar elements, in FIG. 1A, a conventional prior art grinding process of a crowned roll is illustrated. The feed of the grinding device is carried out stepwise in the axial direction of the roll, in which case "waves" corresponding to the pitch of the roll remain in the ground face. In this manner, contact with the roll during use thereof, for example, with a doctor, is not uniform across the whole face of the roll. Also, the grinding process itself is slower, because on the crowned face just a narrow portion of the grinding pulley contacts the face at a time. When a crowned face is ground in this conventional way, the detrimental stepwise profile is always produced, which allows a gap passable by a fiber to remain between a doctor and the roll face. The grinding speed also invariably remains low because of the narrow contact face. With the present standard grinding machines most commonly used, this problem cannot be solved directly.

The stepwise grinding result has been eliminated by means of various additional machining methods, which include honing by means of oscillating grindstones and, in later years, so-called superfinish grinding. In order to reduce the step formation, the contact pulley or disk has also been ground slanting, alternatingly in each direction. Besides on the surface quality, the emphasis in Yankee grinding is almost always also on the time taken by the work. These auxiliary methods are slow and expensive to use.

From the prior art, a tangential grinding device is also known, which is based on a mechanically bent guide. The drawback of this device is a "fixed" crown curve (bar), which is, true enough, adjustable, but adjustment thereof is, however, excessively slow when at the working site. The device was originally designed for the grinding of a certain Yankee cylinder, so that the crown curve was adjusted at the factory for the values of the cylinder concerned.

Figure 1B:
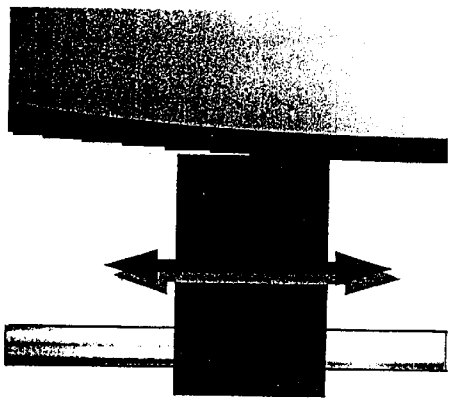
FIG. 1B shows a so-called contact pulley of FIG. 1A in an enlarged scale.

FIG. 1B illustrates the prior art construction, i.e., that shown in FIG. 1A, at the location of the contact pulley.

Figure 2A:
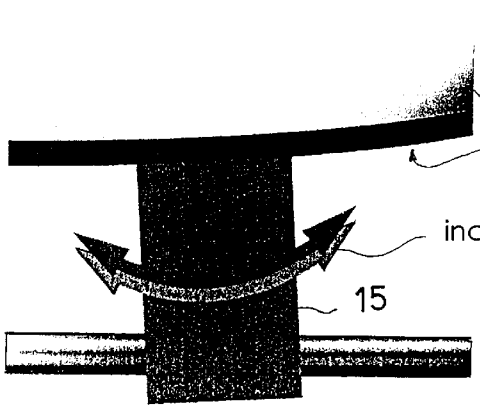
FIG. 2A illustrates an improvement over the prior art method wherein the contact pulley is inclined, and this inclination is carried out by means of a control passed from a microprocessor or equivalent to an actuator, preferably a motor.
Figure 2B:
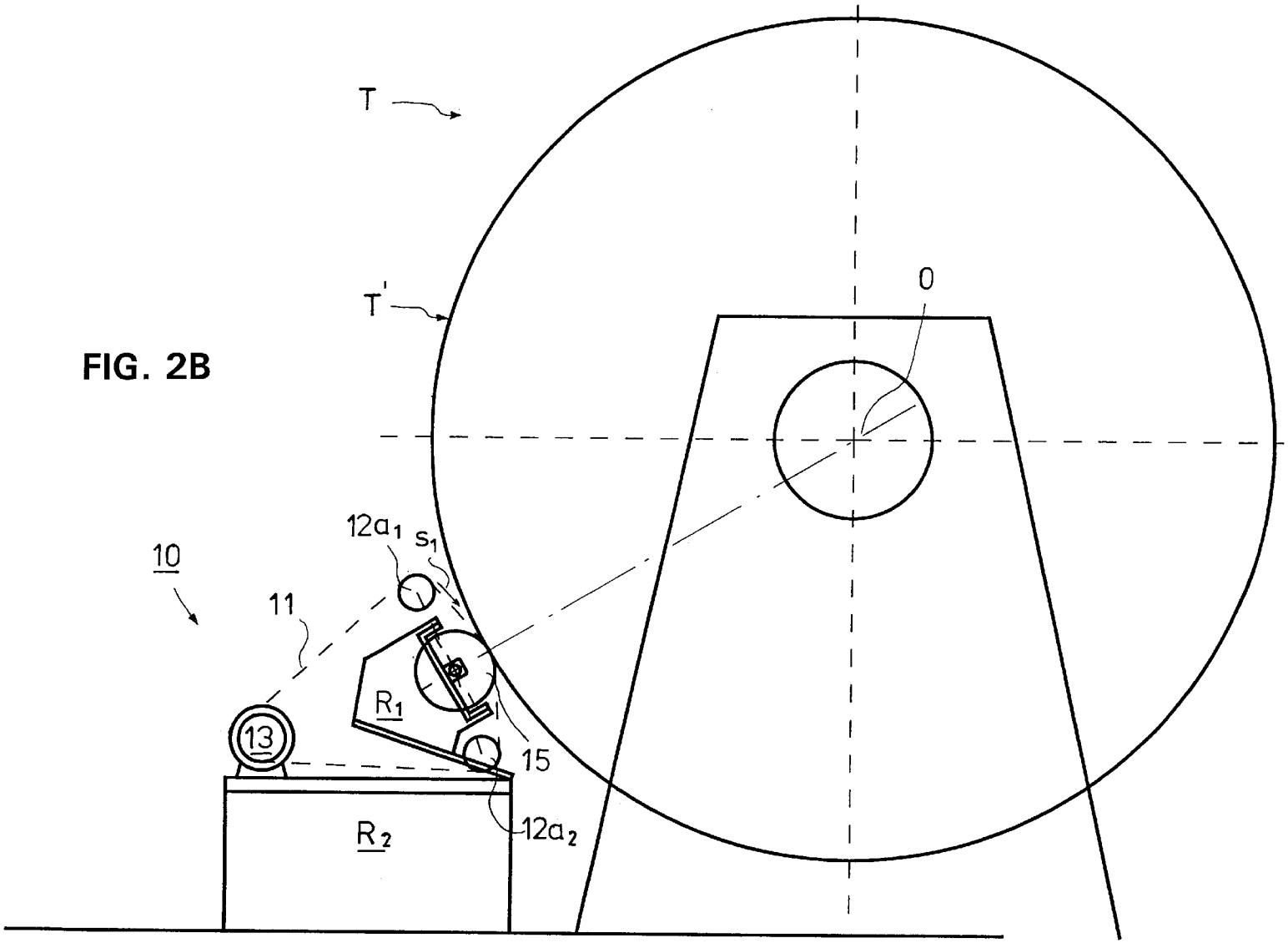
FIG. 2B is a side view of an abrasive-band grinding device in accordance with the invention in the grinding of a Yankee cylinder with a crowned face.
Figure 3A:
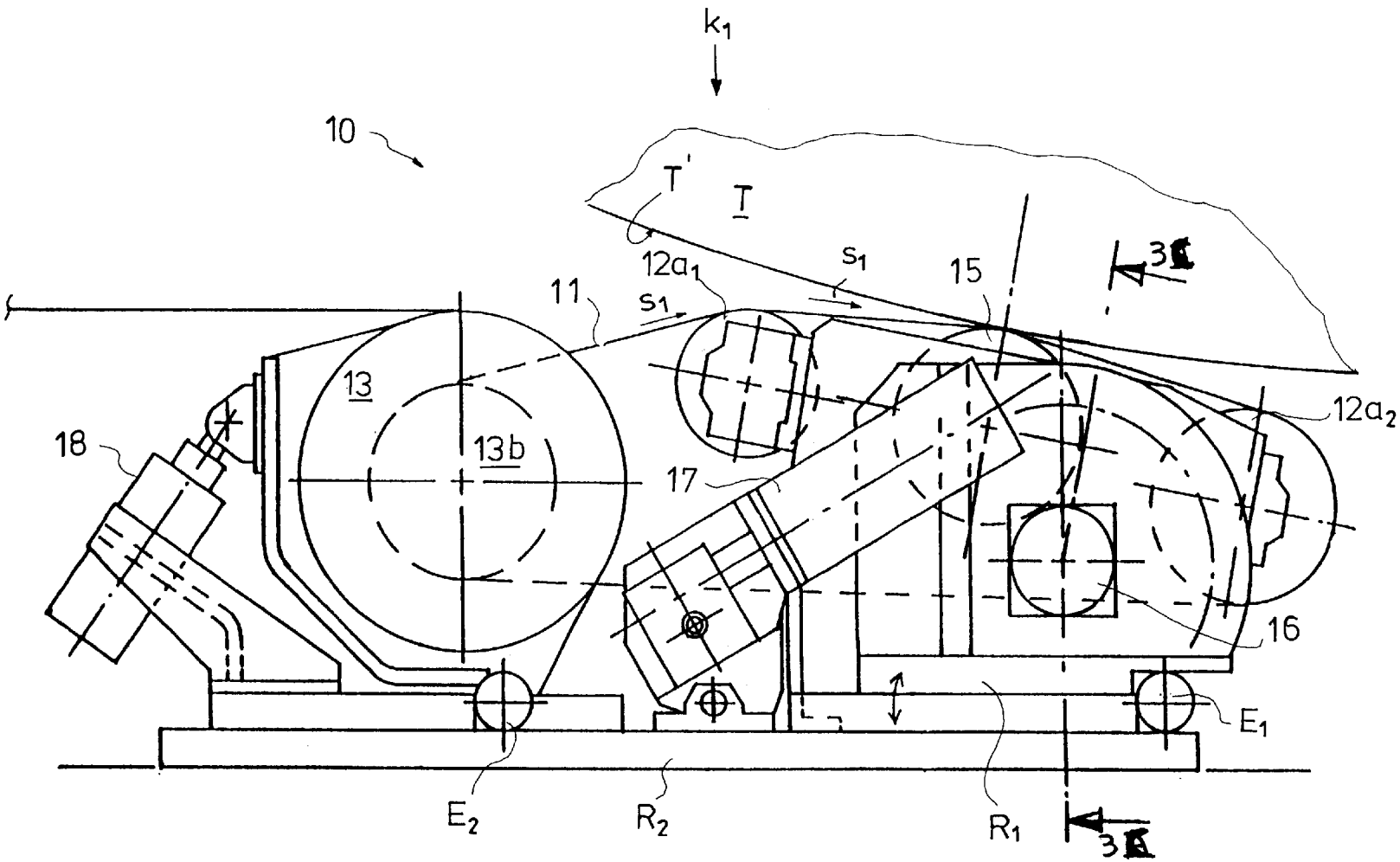
FIG. 3A is a side view of the device in accordance with the invention.

FIG. 2A illustrates a grinding device in accordance with the invention, designated generally as 10, and including a contact pulley 15 controlled by a microprocessor (PC). Its PC controlled contact pulley 15 is fitted against an abrasive band 11 (FIG. 2B). By means of an inclining actuator, such as a motor 16, of the PC-controlled contact pulley 15, the contact pulley 15 is inclined in relation to the face of the roll being ground so that substantially the full width of the abrasive band 11 is pressed into contact with the face T' to be ground on the roll T at each grinding location (FIG. 3A). Inclination of the contact pulley 15 results in the rotation axis of the contact pulley 15 being varied and thus not always parallel to the rotation axis of the roll being ground. The roll T is rotated during grinding. The contact pulley 15 is inclined actively during grinding by means of the motor 16 so as to comply with the desired crown form of the face T' of the roll T to be ground (FIG. 3A).

Figure 4A:
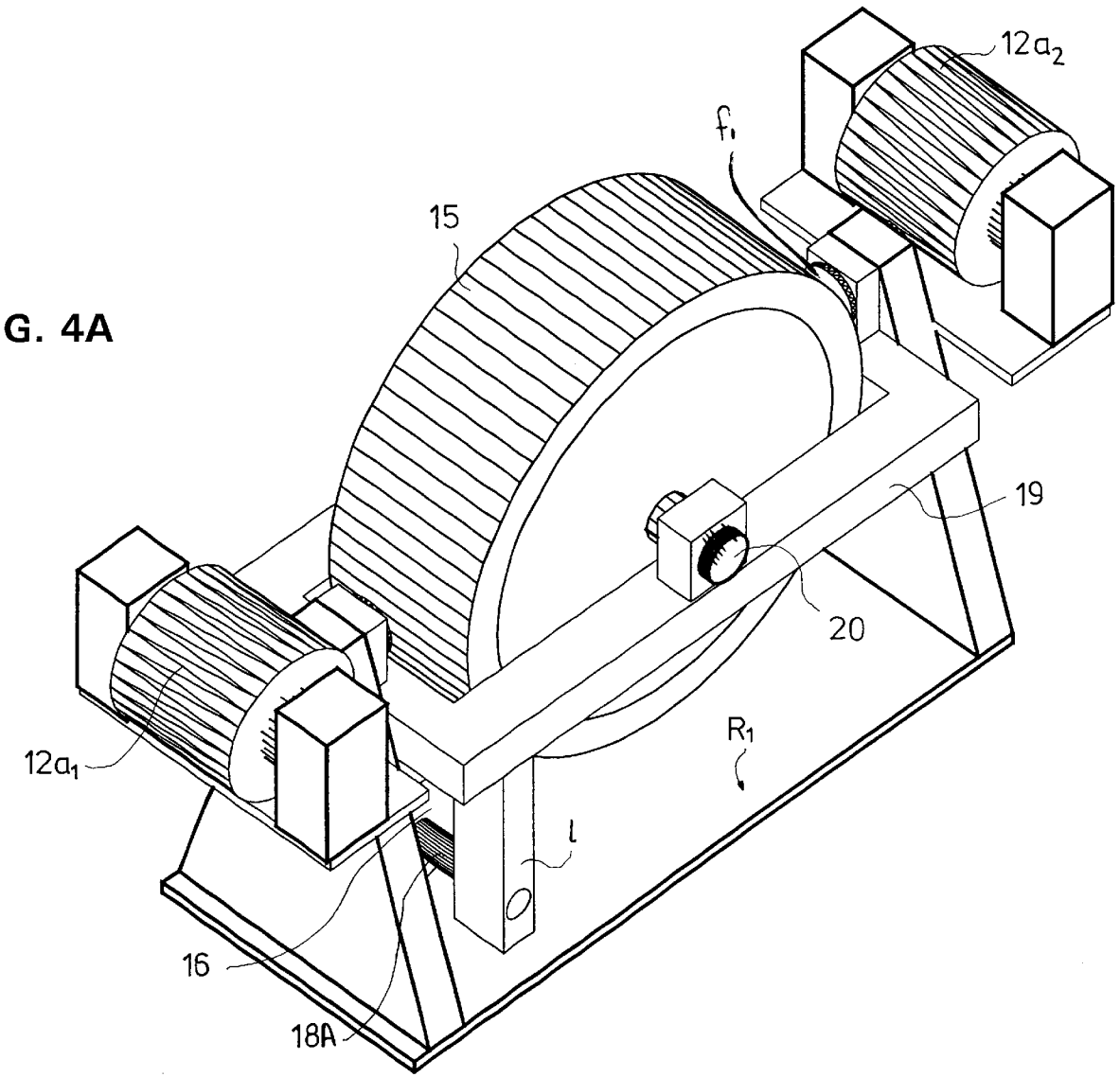
FIG. 4A is a perspective view of an inclinable backup pulley for use in the invention.

Thus, in the PC-controlled abrasive-band grinding device for crowned rolls and cylinders, the grinding line or grinding area of the abrasive band 11 is controlled by inclining the contact pulley 15. The control takes place, for example, by means of the program of the microprocessor (PC) by acting upon the inclinable actuator 16, preferably a stepping motor, which inclines the pulley 15 and, through the actuator, upon a ball-screw 18 and so further upon the contact pulley 15 (FIG. 4A). The grinding face of the abrasive band 11 can be made to reach contact with the tangent of the desired crown curve at the grinding point.

It is an advantage of the PC control, for example, in comparison to curved guides, that the crown values of the program can be altered quickly in the desired way on the site if the conditions change. This is a significant advantage in particular in the grinding of coated Yankee cylinders, in which case, the crown curve must be programmed in accordance with the face and not in accordance with the theoretical curve.

Further, the device is suitable for the sledges of ordinary grinding machines already in use, in which case no new special guides have to be acquired.

It is estimated that, with this device, the grinding time becomes remarkably shorter, as compared with the current prior art constructions, mainly because the grinding can be carried out with full capacity across the entire area of the mantle face.

FIG. 2B is a side view of the grinding device 10 in accordance with the invention in the grinding of the roll T.

Figure 3B:
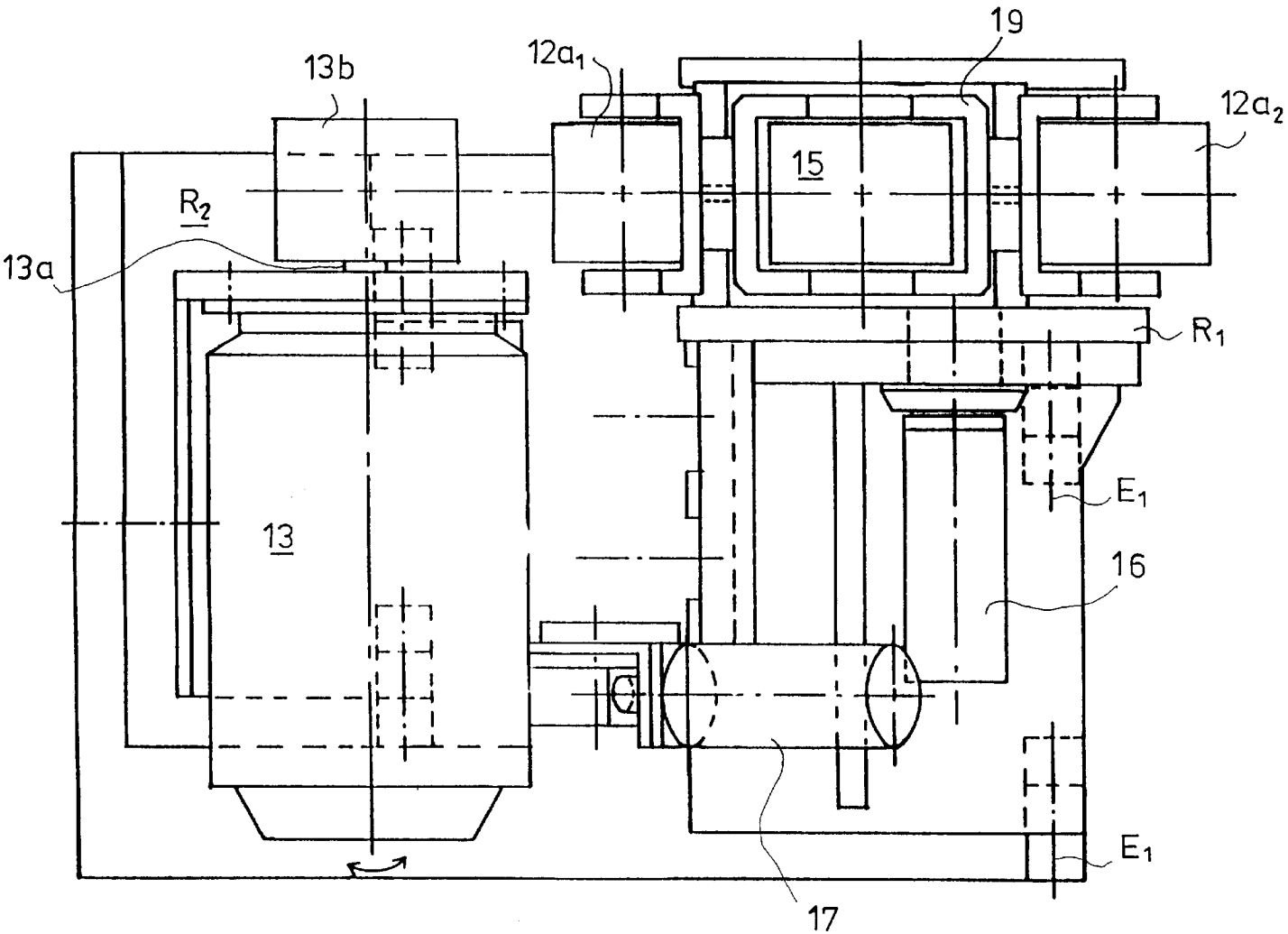
FIG. 3B is a top view of the device shown in FIG. 3A.

FIG. 3A is a side view of the grinding device 10. The roll T, which has a crowned face T', is rotated by means of a motor, and at the same time the abrasive band 11 of the abrasive-band grinding device 10 is moved (in the direction of arrow $S_1$) by means of a motor 13 and pressed against the face to be ground by means of the contact pulley 15. The motor 13 includes an output shaft 13*a* (FIG. 3B). A drive pulley 13*b* is placed on the output shaft 13*a* of the motor 13 and is arranged to move the abrasive band 11, the drive pulley 13*b* being arranged within a loop of the abrasive band 11. The abrasive band 11 is also passed over band guide pulleys 12*a*$_1$, and 12*a*$_2$. The guide pulleys 12*a*$_1$, 12*a*$_2$ are arranged to revolve freely. The backup or contact pulley 15 is mounted on its frame $R_1$ between the band guide pulleys 12*a*$_1$ and 12*a*$_2$ and inside the loop of the band 11. The device 10 comprises means by which the contact pulley 15 can be made to be positioned so at each point to be ground that the radius of the contact pulley 15 at the point to be ground passes through the axis O of rotation of the roll T to be ground (FIG. 2B).

In the device in accordance with the invention, the contact pulley 15 comprises its displaceable frame $R_1$, which is shifted by means of an actuator, preferably the motor 16, so that the radius of the contact pulley 15 at the grinding point always runs through the geometric axis O of rotation of the cylinder to be ground (see FIG. 2B). Inside the band loop of the abrasive band 11, the contact pulley 15 can be displaced and inclined so that the face of the contact pulley 15 at the grinding point is parallel to the tangent of the crown curve and that the radius of the contact pulley 15 at the grinding point additionally passes through the axis O of rotation of the roll T to be ground. The contact pulley 15 is inclined by means of the motor 16 on the frame $R_1$. Further, there is a second motor 17, by whose means the contact pulley 15 can be displaced towards the roll T to be ground or apart from roll T. In this manner, the radius of the contact pulley 15 can be made to pass through the axis O of rotation of the roll T to be ground.

FIG. 3B shows the device in accordance with the invention viewed from the top (in the direction of the arrow $k_1$ in FIG. 3A). The abrasive band 11 of the grinding device 10 is passed as a closed loop over the guide pulleys 12*a*$_1$, 12*a*$_2$ and over the drive pulley 13*b* of the motor 13 and over the contact pulley 15. Thus, the motor 13 is arranged to rotate the drive pulley 13*b* placed on its output shaft 13*a* and thus, to move the band 11 which is passed over the drive pulley 13*b* and over the guide pulleys 12*a*$_1$ and 12*a*$_2$. It can be seen that the backup or contact pulley 15 is situated between the guide pulleys 12*a*$_1$ and 12*a*$_2$. The contact pulley 15 can be inclined in accordance with the invention by means of the actuator 16.

The actuator 16 that inclines the backup or contact pulley 15 is preferably a motor, favorably an electric motor, and most appropriately a stepping motor. The contact pulley 15 is further connected with the frame $R_1$ which can be pivoted around an articulation point $E_1$ by means of the motor 17 arranged between a base frame $R_2$ and the contact-pulley frame $R_1$. Further, the drive pulley 13*b* with its motor 13 can be shifted by an actuator 18, so that the abrasive band 11 passing over the drive pulley 13*b* can be tightened by means of the actuator 18. Thus, the motor 13 is articulated to pivot around the articulation point $E_2$ by means of the actuator 18.

Figure 3C:
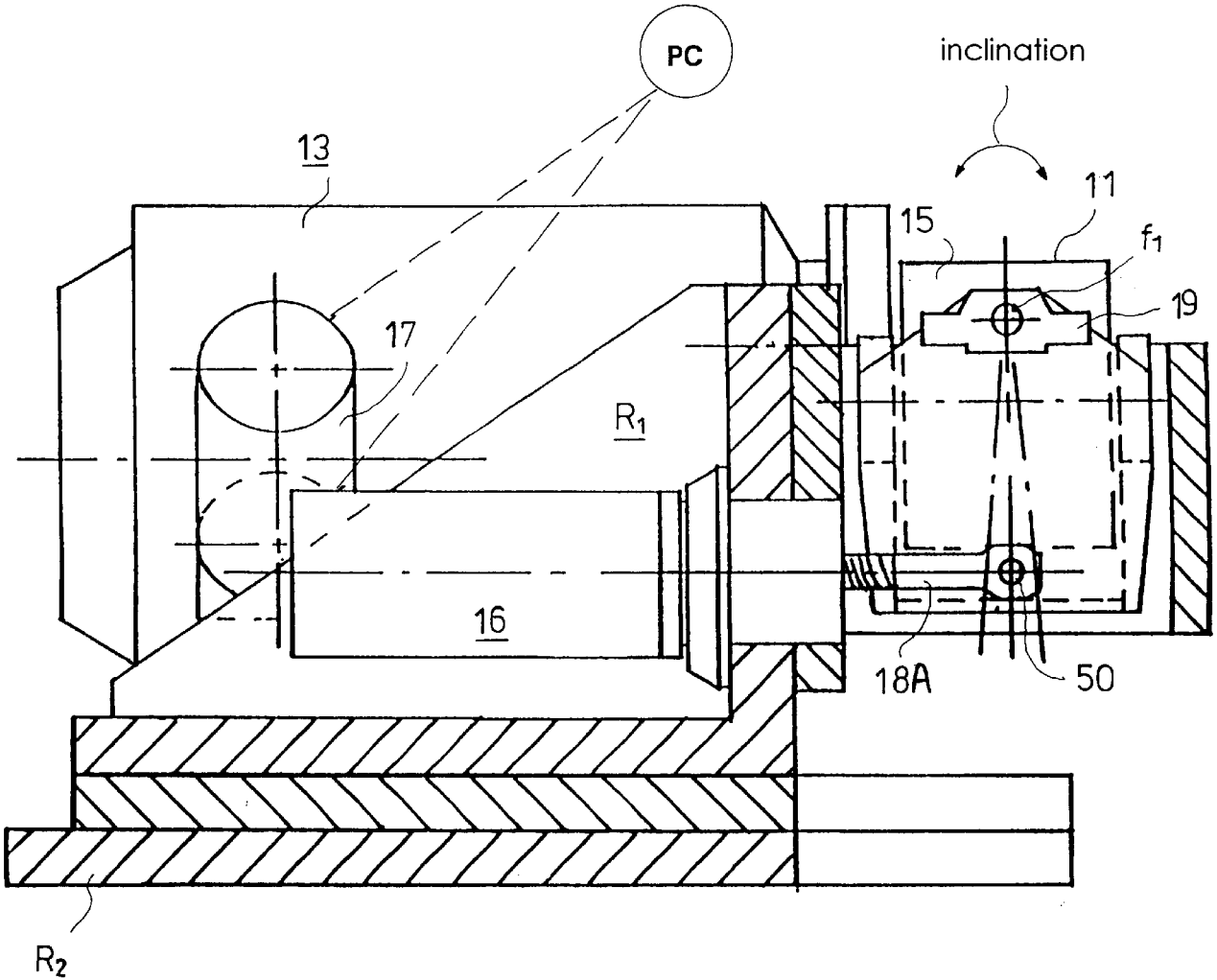
FIG. 3C is a sectional view taken along the line 3C—3C in FIG. 3A.

FIG. 3C is a sectional view taken along the line 3C—3C in FIG. 3A. The contact pulley 15 can be inclined by means of the actuator 16, which as noted above is preferably a motor. The motor 16 operates a spindle 18A, which is in engagement with a frame 19. The frame 19 is linked to pivot around link and bearing points defined by bearings 30*a*,30*b* (FIG. 4B) on the frame $R_1$. The contact pulley 15 is mounted to revolve freely on the bearings 20 on the frame 19.

The motor 16 for inclining the contact pulley 15 is placed so that the spindle 18A displaced by the inclining motor 16 is perpendicular to the direction of rotation $S_1$ of the band. Similarly, the motor 17 that inclines the frame $R_1$ on which the contact pulley 15 is placed is arranged to pivot the frame $R_1$ in a plane parallel to the plane of the loop of rotation of the band 11.

FIG. 4A is a separate illustration showing the bearing system of the inclination of the contact pulley 15. The abrasive band 11 is passed over the reversing pulleys or rolls 12*a*$_1$, 12*a*$_2$ and over the PC-controlled contact pulley 15 between them.

Figure 4B:
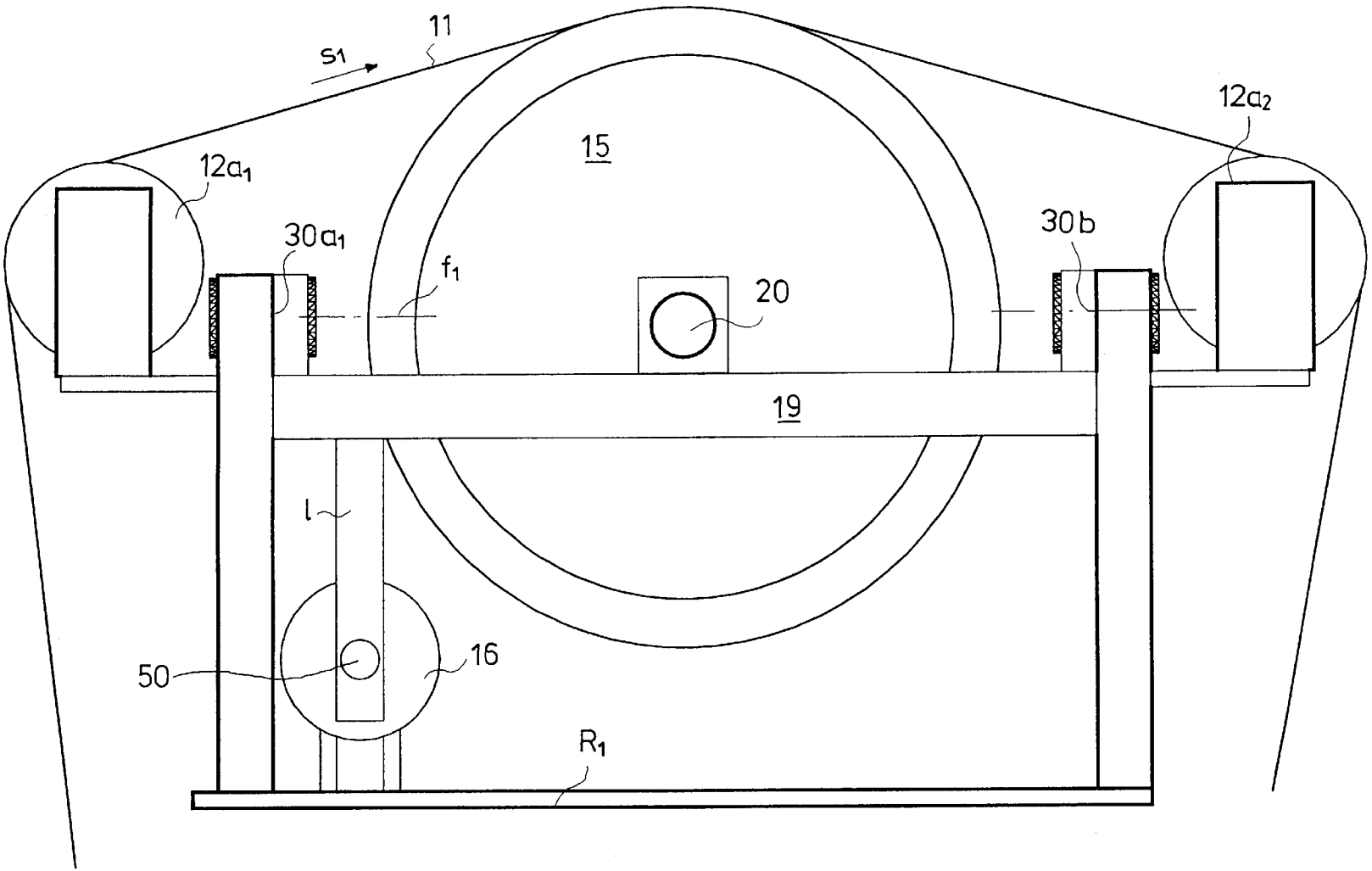
FIG. 4B shows the device in accordance with the invention viewed in the direction of the arrow $k_1$ in FIG. 4A.

As shown in FIG. 4B, in connection with the backup or contact pulley 15, on the frame 19, there are articulation points, preferably bearings 30*a* and 30*b*, and the contact pulley 15 can be inclined around the pivot shaft $f_1$ between the bearings. The frame 19 passing around the contact pulley 15 is coupled with a motor 16 by means of the spindle 18A. In accordance with the invention, the motor 16 is preferably an electric motor and most appropriately a stepping motor, and the spindle 18A is preferably a ball-screw. The contact pulley 15 is mounted to revolve freely on bearing/bearings 20 on the frame 19. The bearings 30*a* and 30*b* are arranged between the frame 19 and the frame $R_1$. The spindle 18A is mounted from an articulation point 50 on an arm 1 of the frame 19. Preferably, the actuator 16 is also mounted by means of a bearing in relation to the frame $R_1$. In this way, a little movement of pivoting is permitted for the actuator 16. The guide pulleys 12*a*$_1$, 12*a*$_2$, which have been mounted to revolve freely, are placed on the frame $R_1$.

Figure 4C:
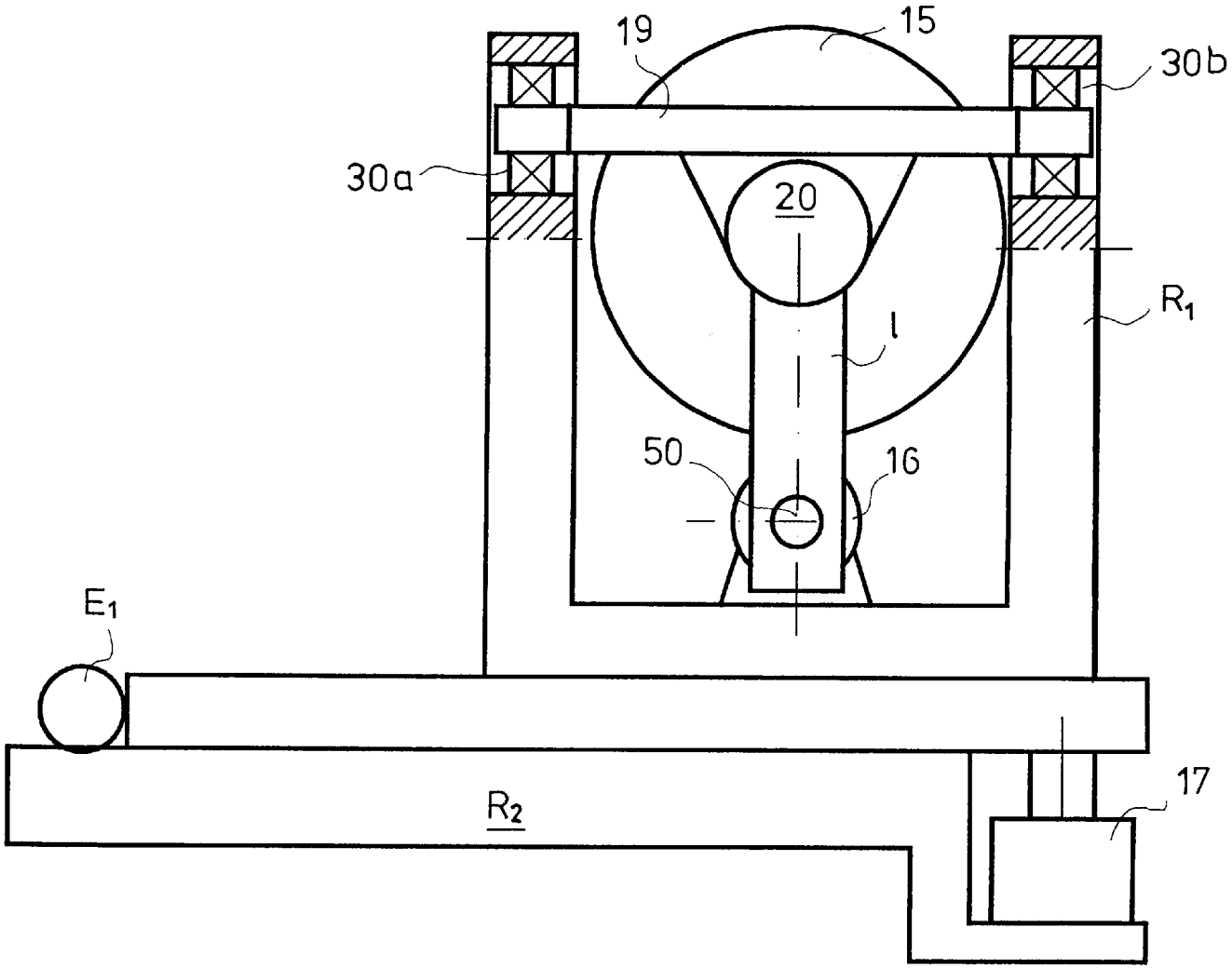
FIG. 4C is an illustration of the inclining of the frame of the device by means of a second actuator.

The embodiment shown in FIG. 4C illustrates pivoting of the frame $R_1$ around the articulated point $E_1$ by means of the actuator 17, which is as noted above preferably a stepping motor. The contact pulley 15 can be positioned so that its radius at the grinding point always passes through the central axis O of the roll T to be ground and rotated (FIG. 2B).

In the method in accordance with the invention, the contact pulley 15 is controlled so that it always complies with the desired shape of the face of the roll to be ground. In the method in accordance with the invention, the control of the actuator 16, preferably a motor 16, is carried out based on the control coming from the microprocessor (PC) and similarly, the control of the second actuator 17, again which is preferably a motor and most appropriately a stepping motor, is carried out based on the control coming from the microprocessor (PC). Such controls may have been formed so that a certain face shape has been programmed in advance in the microprocessor, in which case, when the grinding makes progress, the program gives the set values corresponding to the grinding position to the actuators 16 and 17.

In the method in accordance with the invention, the direction of the grinding line or area is affected under positive control by means of the contact pulley 15 by controlling the abrasive band 11 by means of the contact pulley 15. As such, the contact pulley is inclined by means of the motor 16, and its position in relation to the roll to be ground is also regulated by means of the second actuator 17. The inclining of the abrasive band 11 takes place by inclining the contact pulley 15. The contact pulley 15 is inclined around the shaft $f_1$, which is perpendicular to the plane that passes through the central axis O of the roll T to be ground and through the axis of rotation of the contact pulley 15.

In the method in accordance with the invention, the motors 16 and 17 can be controlled at the same time. The control of the motors 16 and 17 can come from the PC through a program fed in advance into the PC, or also manually. By means of the program, the set values given to the motors 16 and 17 are changed along with the progress made by the grinding.

Above, some preferred embodiments of the invention have been described, and it is obvious to a person skilled in the art that numerous modifications can be made to these embodiments within the scope of the inventive idea defined in the accompanying patent claims. As such, the examples provided above are not meant to be exclusive. Many other variations of the present invention would be obvious to those skilled in the art, and are contemplated to be within the scope of the appended claims. For example, although two guide pulleys are shown in the illustrated embodiment, the grinding device in accordance with the invention may include any number of such guide pulleys.

We claim:

1. An abrasive-band grinding device for rolls, comprising a looped abrasive band, rotation means coupled to said abrasive band for rotating said abrasive band, guide pulleys arranged in the loop of said abrasive band, a contact pulley having an axis of rotation, said contact pulley being arranged in the loop of said abrasive band between said guide pulleys, said contact pulley being structured and arranged to press said abrasive band against a face of the roll, inclining means connected to said contact pulley for adjustably inclining the axis of rotation of said contact pulley and maintaining the axis of rotation of said contact pulley substantially parallel to the face of the roll and thus said abrasive band is pressed by said contact pulley in compliance with the face of the roll, a first stationary frame, a second frame arranged on said first frame, said second frame being movable relative to said first frame, a third frame arranged on said second frame, said third frame being movable relative to said second frame.

first bearing means for revolvingly mounting said contact pulley on said third frame, and second bearing means for pivotally mounting said third frame on said second frame.

2. The abrasive-band grinding device of claim 1, wherein said inclining means comprise a motor, further comprising control means for controlling actuation of said motor and thus the inclination of the axis of rotation of said contact pulley.

3. The abrasive-band grinding device of claim 1, said inclining means comprise a motor coupled to said third frame.

4. The abrasive-band grinding device of claim 1, wherein said first bearing means comprise a pair of bearings arranged on said third frame, one at each transverse side of said contact pulley, and said second bearing means comprise a pair of bearings arranged on said second frame, one on each radial side of said contact pulley.

5. The abrasive-band grinding device of claim 1, wherein said inclining means comprise a motor, control means connected to said motor for controlling said motor, and a spindle coupled to said motor and to said third frame.

6. The abrasive-band grinding device of claim 5, wherein said motor is structured and arranged to displace said spindle along a linear path.

7. The abrasive-band grinding device of claim 5, wherein said motor is structured and arranged to displace said spindle, said spindle being a ball-screw device.

8. The abrasive-band grinding device of claim 5, wherein said motor is connected to said second frame.

9. The abrasive-band grinding device of claim 1, further comprising a frame, said guide pulleys, said contact pulley and said inclining means being arranged on said frame, said rotation means comprising a motor arranged on said frame and having an output shaft and a drive pulley arranged on said output shaft, said drive pulley being situated in the loop of said abrasive band such that rotation of said drive pulley causes rotation of said abrasive band.

10. A method for grinding rolls, comprising the steps of movably arranging a second frame on to a first stationary frame.

movably arranging a third frame on to said second frame, revolving mounting a contact pulley to said third frame, guiding a looped abrasive band over guide pulleys, pressing said contact pulley arranged in the loop of the abrasive band toward the roll to be ground such that the abrasive band is pressed thereby against a face of the roll to be ground, coupling a motor to the contact pulley, and controlling the motor to adjustably incline the axis of rotation of the contact pulley to maintain the axis of rotation of said contact pulley substantially parallel to the face of the roll such that said abrasive band is pressed by said contact pulley in compliance with the face of the roll.

11. The method of claim 10, further comprising the step of:

controlling the motor by means of a microprocessor.

12. The method of claim 10, further comprising the steps of:

attaching the contact pulley to a frame, and displacing the contact pulley toward and away from the roll to be ground by means of an actuator arranged to incline the frame.

13. The method of claim 12, wherein the actuator is a motor which receives its control from a microprocessor.

14. The method of claim 10, further comprising the step of:

rotating the roll to be ground during grinding.

15. The method of claim 10, wherein the contact pulley is inclined until the face of the contact pulley is substantially parallel to a tangent of the roll at each grinding point.

16. An abrasive-band grinding device for rolls, comprising a looped abrasive band, rotation means coupled to said abrasive band for rotating said abrasive band, guide pulleys arranged in the loop of said abrasive band, a contact pulley having an axis of rotation, said contact pulley being arranged in the loop of said abrasive band between said guide pulleys, said contact pulley being structured and arranged to press said abrasive band against a face of the roll, a first stationary frame, a second frame arranged on said first frame, said second frame being movable relative to said first frame, a third frame arranged on said second frame, said third frame being movable relative to said second frame, first bearing means for revolvingly mounting said contact pulley on said third frame, second bearing means for pivotally mounting said third frame on said second frame, inclining means connected to said contact pulley for adjustably inclining the axis of rotation of said contact pulley and maintaining the axis of rotation of said contact pulley substantially parallel to the face of the roll and thus said abrasive band is pressed by said contact pulley in compliance with the face of the roll, said inclining means comprising a motor coupled to said third frame, and control means for controlling actuation of said motor and thus the inclination of the axis of rotation of said contact pulley.

17. An abrasive-band grinding device for rolls, comprising a first stationary frame, a second movable frame arranged on said first frame, said second frame being movable relative to said first frame, a looped abrasive band, rotation means coupled to said abrasive band for rotating said abrasive band, guide pulleys arranged in the loop of said abrasive band, a contact pulley supported on said second frame having an axis of rotation, said contact pulley being arranged in the loop of said abrasive band between said guide pulleys, said contact pulley being structured and arranged to press said abrasive band against a face of the roll, an actuator connected to said first frame and said second frame for pivoting said second frame in relation to the face of the roll around an articulation point such that said contact pulley is displaceable toward and away from the face of the roll, and inclining means connected to said contact pulley for adjustably inclining the axis of rotation of said contact pulley whereby the axis of rotation of said contact pulley is maintained substantially parallel to the face of the roll and thus said abrasive band is pressed by said contact pulley in compliance with the face of the roll.

18. An abrasive-band grinding device for rolls, comprising a looped abrasive band, rotation means coupled to said abrasive band for rotating said abrasive band, guide pulleys arranged in the loop of said abrasive band, a contact pulley having an axis of rotation, said contact pulley being arranged in the loop of said abrasive band between said guide pulleys, said contact pulley being structured and arranged to press said abrasive band against a face of the roll, inclining means connected to said contact pulley for adjustably inclining the axis of rotation of said contact pulley and maintaining the axis of rotation of said contact pulley substantially parallel to the face of the roll and thus said abrasive band is pressed by said contact pulley in compliance with the face of the roll, and p1 a microprocessor coupled to said inclining means for controlling said inclining means such that said contact pulleys conforms to the curvature of the face of the roll.

19. An abrasive-band grinding device for rolls, comprising a frame, a looped abrasive band, rotation means coupled to said abrasive band for rotating said abrasive band, guide pulleys arranged on said frame and in the loop of said abrasive band, a contact pulley having an axis of rotation, said contact pulley being arranged on said frame and in the loop of said abrasive band between said guide pulleys, said contact pulley being structured and arranged to press said abrasive band against a face of the roll, inclining means arranged on said frame and connected to said contact pulley for adjustably inclining the axis of rotation of said contact pulley and maintaining the axis of rotation of said contact pulley substantially parallel to the face of the roll and thus said abrasive band is pressed by said contact pulley in compliance with the face of the roll, said rotation means comprising a motor pivotally mounted on said frame for rotation about an articulation point and having an output shaft and a drive pulley arranged on said output shaft, said drive pulley being situated in the loop of said abrasive band such that rotation of said drive pulley causes rotation of said abrasive band, and an actuator coupled to said motor for rotating said motor about said articulation point.

20. A method for grinding rolls, comprising the steps of:

movably arranging a second frame on to a first stationary frame, movably arranging a third frame on to said second frame, revolvingly mounting a contact pulley to said third frame, guiding a looped abrasive band over guide pulleys, pressing said contact pulley arranged in the loop of the abrasive band toward the roll to be ground such that the abrasive band is pressed thereby against a face of the roll to be ground, and adjustably inclining the axis of rotation of said contact pulley to maintain the axis of rotation of said contact pulley substantially parallel to the face of the roll such that said abrasive band is pressed by said contact pulley in compliance with the face of the roll.

* * * * *